US010464717B1

(12) United States Patent
Rosenshine

(10) Patent No.: US 10,464,717 B1
(45) Date of Patent: Nov. 5, 2019

(54) APPARATUS FOR HOLDING A BAG OPEN

(71) Applicant: Howard Rosenshine, Downingtown, PA (US)

(72) Inventor: Howard Rosenshine, Downingtown, PA (US)

( * ) Notice: Subject to any disclaimer, the term of this patent is extended or adjusted under 35 U.S.C. 154(b) by 0 days.

(21) Appl. No.: 16/019,312

(22) Filed: Jun. 26, 2018

Related U.S. Application Data

(60) Provisional application No. 62/527,219, filed on Jun. 30, 2017.

(51) Int. Cl.
*B65D 33/00* (2006.01)
*B65F 1/14* (2006.01)
*B65B 67/12* (2006.01)

(52) U.S. Cl.
CPC ..... *B65D 33/007* (2013.01); *B65F 1/1415* (2013.01); *B65B 67/1255* (2013.01); *B65F 2240/138* (2013.01)

(58) Field of Classification Search
CPC ..... B65F 1/1415; B65F 1/06; B65F 1/141; B65B 67/12; B65B 67/1205; B65B 67/1233
USPC ..... 248/95, 97, 99, 101
See application file for complete search history.

(56) References Cited

U.S. PATENT DOCUMENTS 4,319,726 A * 3/1982 Andersson ..... B65B 67/12 171/43
5,082,219 A * 1/1992 Blair ..... B65F 1/1415 141/390
5,927,856 A * 7/1999 Hung ..... A45C 13/06 150/120
6,676,092 B2 * 1/2004 Tsai ..... B65F 1/1415 248/149
8,834,023 B1 * 9/2014 Laera ..... B65B 67/1238 383/33
9,162,157 B2 * 10/2015 Scarborough ..... A63J 7/00
10,093,443 B2 * 10/2018 Strom ..... B65B 67/1211
2009/0014603 A1 * 1/2009 Zima ..... B65B 67/1205 248/101

* cited by examiner

*Primary Examiner* — Steven M Marsh
(74) *Attorney, Agent, or Firm* — Keeley DeAngelo LLP; W Scott Keeley

(57) ABSTRACT

A flexible, annular band of variable diameter keeps a yard bag open and properly oriented for use in receiving debris and manipulating the bag. The flexible, annular band may be locked to a fixed or variable diameter to fit the opening of common yard bags. By contracting the band, it can be placed inside the opening of the bag, expanded to the bag's diameter, and then locked to hold the bag open to receive yard debris. When the bag is full, the flexible annular band is unlocked and contracted for removal.

14 Claims, 5 Drawing Sheets

APPARATUS FOR HOLDING A BAG OPEN

TECHNICAL FIELD

The present disclosure relates generally to outdoor lawn and garden tools and specifically to methods and apparatus for assisting in the use of disposable paper bags for yard-waste collection.

BACKGROUND

Collection and disposal of residential yard waste is a common landscaping task. Tree leaves and grass clippings from lawn-mowing, gardening, pruning and landscaping generate volumes of waste to be moved to a disposal site.

A common disposal method involves the use of 30-gallon multi-ply paper bags which come folded and packaged in stores. For purposes of clarity, these will be referred to as "yard bags" or simply "bags."

In the present disclosure, "collection" is used to describe the process of filling yard bags with landscape refuse. Removal refers to the process of disposal in which filled yard bags are retrieved and removed from a location for appropriate disposal. Removal typically involves placing the filled yard bags at the property curbside, where they are retrieved by a standard residential trash-disposal service or a yard-waste recycling service, depending on local ordinances.

An active-locking mechanism refers to a means of fastening by user intent, such as a latch. or clasp, preventing movement once locked. A passive locking mechanism such as a friction slide, ratchet or location fit prevents or impedes unlocking movement without user intervention. An interference mechanism is a locking mechanism such as a ball-and-dent arrangement.

In use, once they are unfolded and placed upright where needed, yard bags tend to flop over, making it difficult to fill the bag. Once a bag is filled with debris it must be transported for removal. A full bag is often heavy to lift and carry and as such it is typically grasped by the open bag edge and dragged. Since the bag is typically composed of relatively thin brown paper, it tends to rip at the edge where it is grasped.

SUMMARY

A flexible, annular band of variable diameter keeps a yard bag open and properly oriented for use in receiving debris and manipulating the bag. The flexible, annular band may be locked to a fixed. diameter within a range that fits the opening of common yard bags. The embodiment also serves as a handle for assisting with moving a full bag without damaging it.

By contracting the band to slightly smaller than the maximum diameter of the top opening of a typical bag, the embodiment can be placed inside the opening of the bag, expanded to the diameter of the bag, and then locked to hold the bag open to receive yard debris. When the bag is full, the flexible annular band may be unlocked and contracted slightly along its circumference for upward removal.

The flexible annular band consists of a flange around the circumference and an integral collar on the top edge of the flange. This collar is designed to be wider than a bag's diameter so as to rest atop the bag's top edge during placement onto the bag. The collar houses, at its proximal end, a partial inner member of about one-fourth the circumference of the collar. This inner member's flared, proximal end can be pressed by hand to contract and inserted into the receiving, distal end of the collar to fasten the apparatus closed in a ring.

The partial inner member is constructed of a material that allows flex and spring, allowing it to be manipulated by pressing its flared end and inserting it into the receiving end of the collar. Once inserted into the collar, the partial inner member's flared end re-expands, imparting a sliding frictional force against the inside wall of the collar. This constant frictional force is such that the apparatus's diameter is easily manipulated by the user while the apparatus remains firmly in place.

The frictional force of the partial inner member and the expansion force of the apparatus together offer a structural rigidity that allows the bag to be held open and filled, and to maintain this maximally open position even if it is tipped over on its side. Because the friction force is created by a flared and splined end, it tends to create greater friction when moving the partial inner member inward, towards the wide end of the flare, and less friction when moving the partial inner member outward, towards the narrow end of the flare. In some embodiments a tapered plug is inserted into the flared and splined end wherein greater insertion increases the size of the flare and lesser insertion reduces the size of the flare of the splines.

During use, the partial inner member is inserted into the opposite end of the collar and the diameter of the flange is contracted to be slightly less than the diameter of the bag. The ring is placed on the open bag, the flexible annular band is gripped and expanded along its circumference to the bag's maximal opening, creating a location fit between the outer diameter of the flexible annular band and the inner diameter of the bag. As well, the partial insert is passively locked in place inside the collar, via friction. The location fit is passive in that it can be unlocked by pulling open the apparatus at the point of closure.

The outer-diameter surface of the flange may be given a full or partial coating of a friction-enhancing coating such as rubber or grit to tighten the location fit.

Once the annular band is installed, the collar acts as an omnidirectional grip to assist in the transport of a filled yard bag. The apparatus is constructed of a material weight that is light enough to rest on the bag without collapsing it. One skilled in the art understands that in the example embodiment, a passive-locking mechanism has been described. An active-locking mechanism may also be used. One skilled in the art understands that an active-locking mechanism may be a ratcheting clamp, clasp, pin, clamp or other locking device.

Other objects and features will become apparent from the following detailed description considered in conjunction with the accompanying drawings. The drawings are designed to illustrate rather than limit the invention.

BRIEF DESCRIPTION OF THE DRAWINGS

To assist those of skill in the art in making and using the disclosed invention and associated methods, reference is made to the accompanying figures, wherein.

DESCRIPTION

Figure 1:
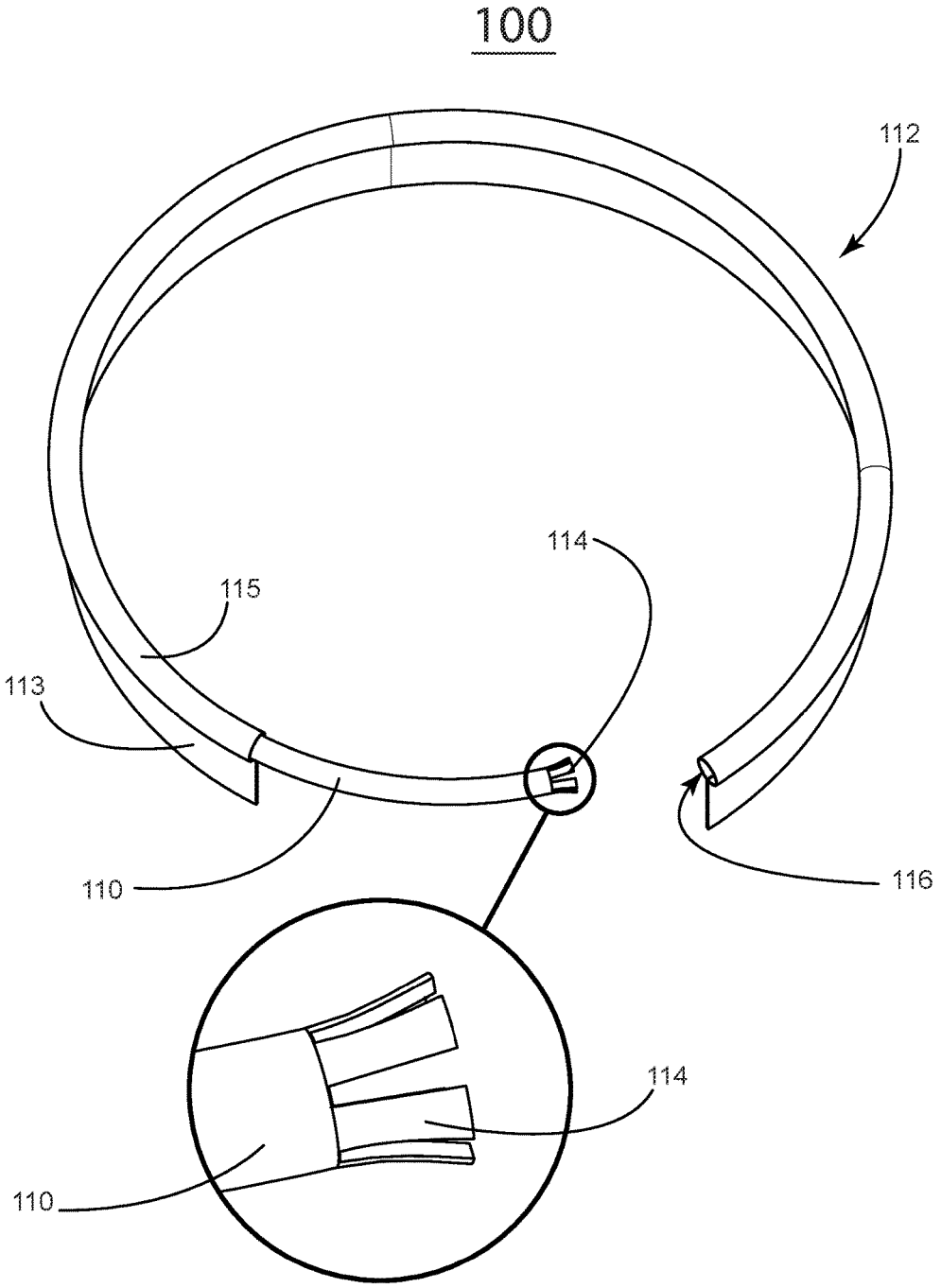
FIG. 1 is a perspective view of the embodiment and an exploded view of the flared location fitting.

In FIG. 1, 100, a flexible, annular band apparatus 112 is comprised of a flange 113 and a collar 115 that houses a partial inner ring 110. The partial inner ring has at its proximal end a flared location fitting 114 that when inserted into the collar's distal receiving end 116 holds the apparatus closed. By varying how much of the partial inner ring is inserted, the apparatus's circumference can be adjusted to fit various bag sizes.

Figure 2:
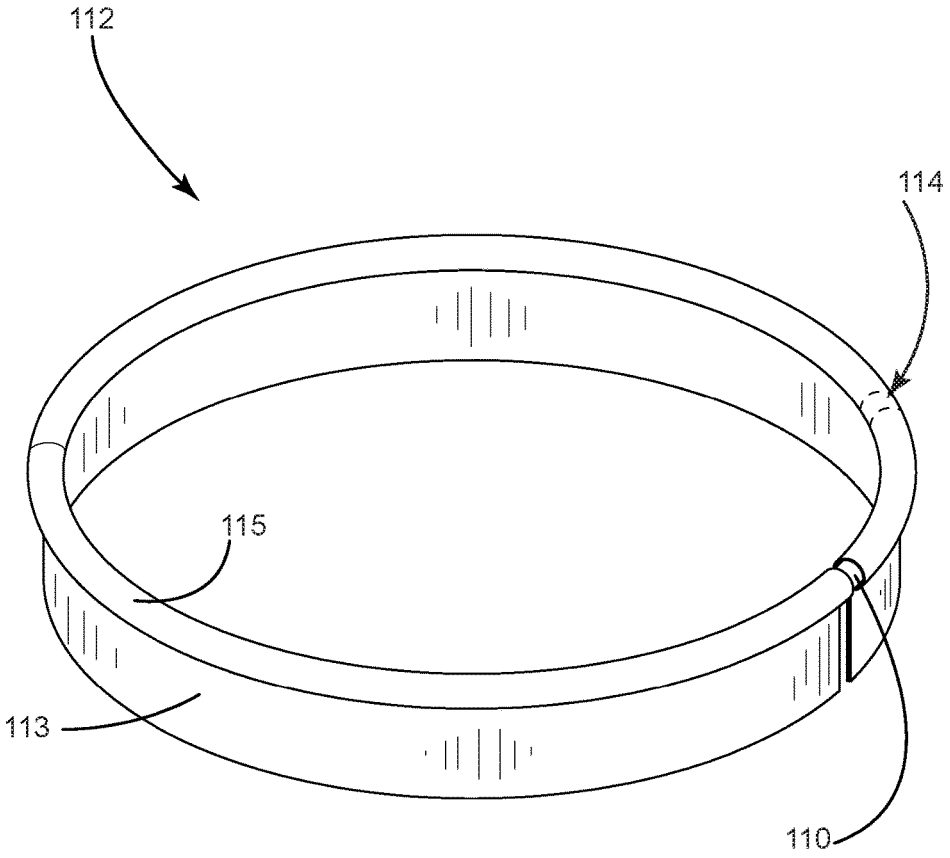
FIG. 2 is a perspective view of the apparatus contracted to a small diameter.

In FIG. 2 the apparatus is contracted to its smallest possible diameter. The flared end 114 of the partial inner ring 110 is shown in its farthest insertion point at the apparatus's 112 farthest contraction.

Figure 3:
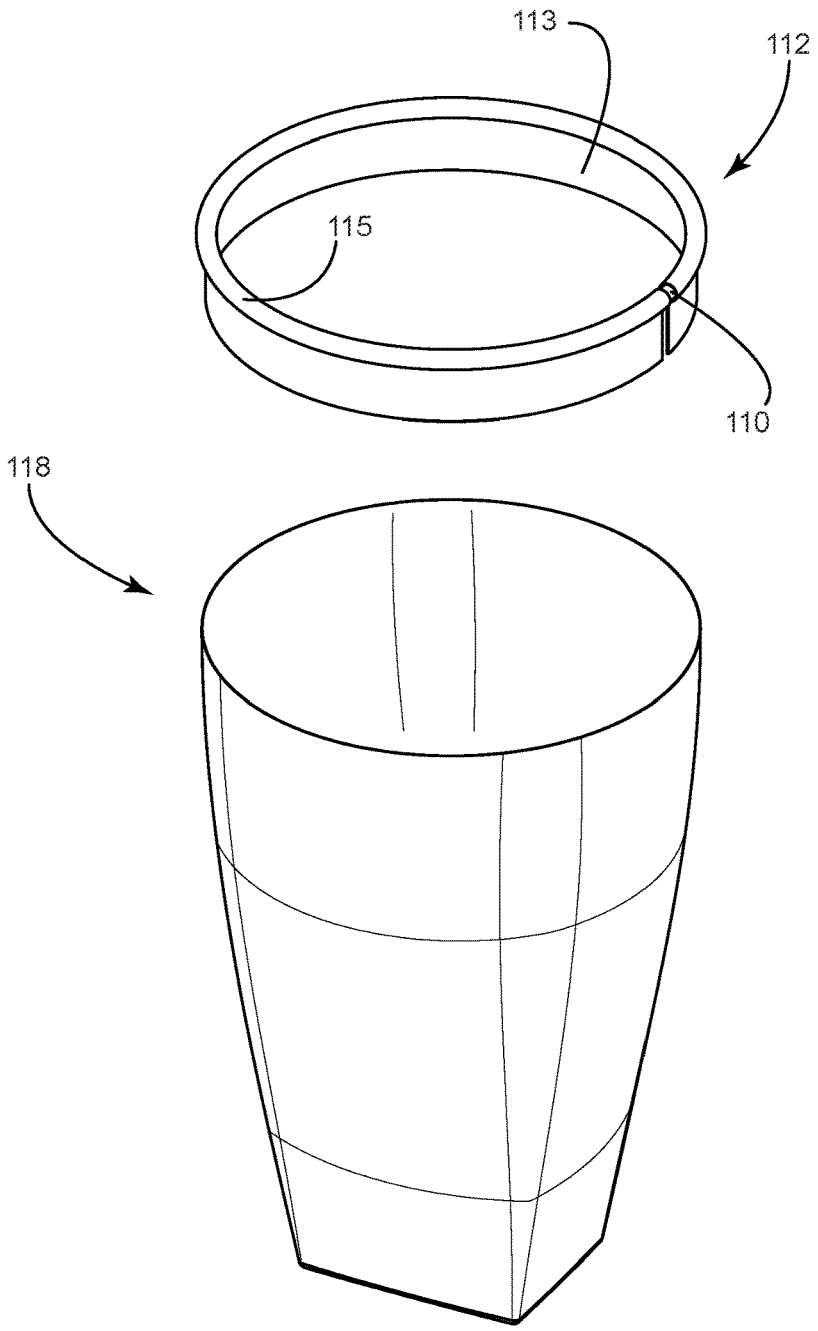
FIG. 3 is an exploded, perspective view of the apparatus as oriented on a provided example bag.

In an exploded view FIG. 3 shows the apparatus's 112 orientation on a provided example bag 118. The apparatus's diameter has been manually adjusted to approximate the diameter of the bag. The partial inner ring 110 has been inserted into the collar 115 to a depth adequate to reach a circumference that effects a press fit in the bag.

Figure 4:
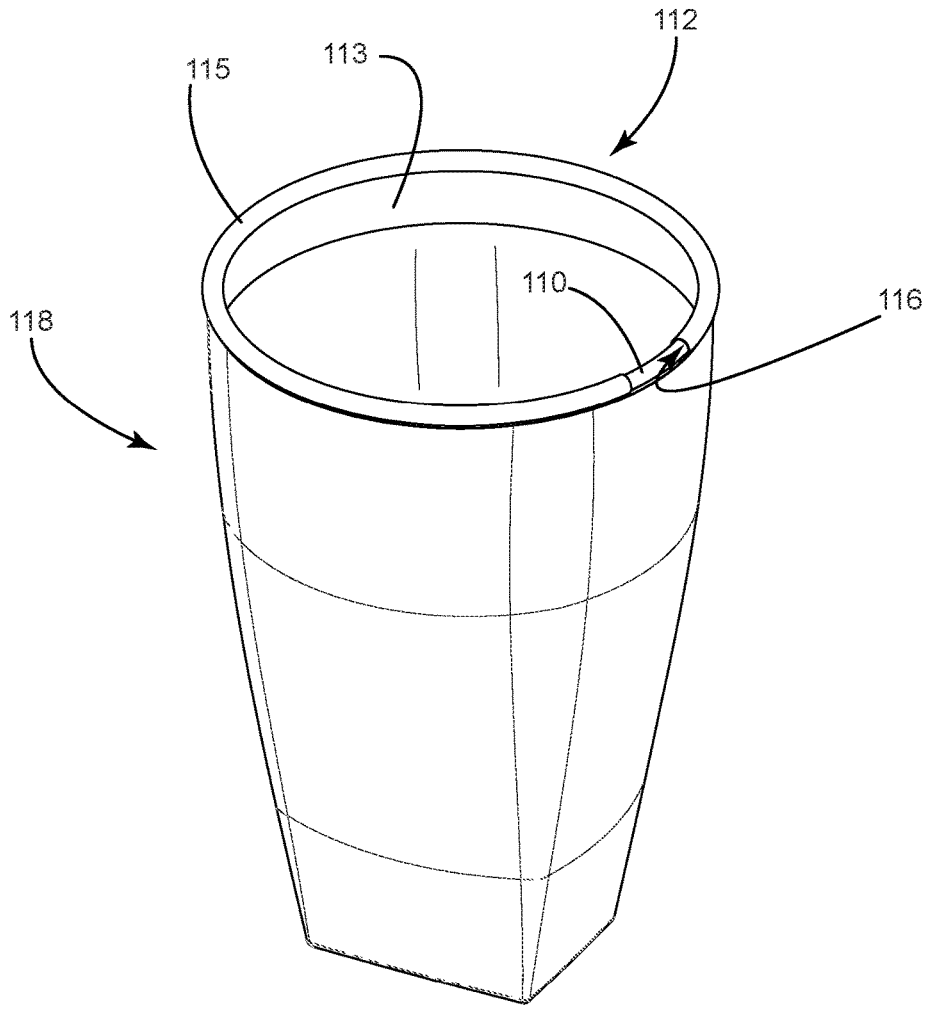
FIG. 4 is a perspective view of the apparatus accommodating a provided, large bag.

In FIG. 4, the apparatus 112 is shown accommodating a provided, large bag 118. The partial inner ring 110 is inserted into the receiving end 116 of the collar to a degree adequate to reach a circumference that effects a press fit. One skilled in the art can observe that it may be further expanded or contracted to fit bags of varying size. The flange 113 presses against the inner diameter of the bag 118, supporting the apparatus and holding its collar 115 atop the uppermost edge of the bag 118. Installed, the collar 115 of the apparatus 112 serves as manual grip so that the filled bag may be easily relocated.

Figure 5:
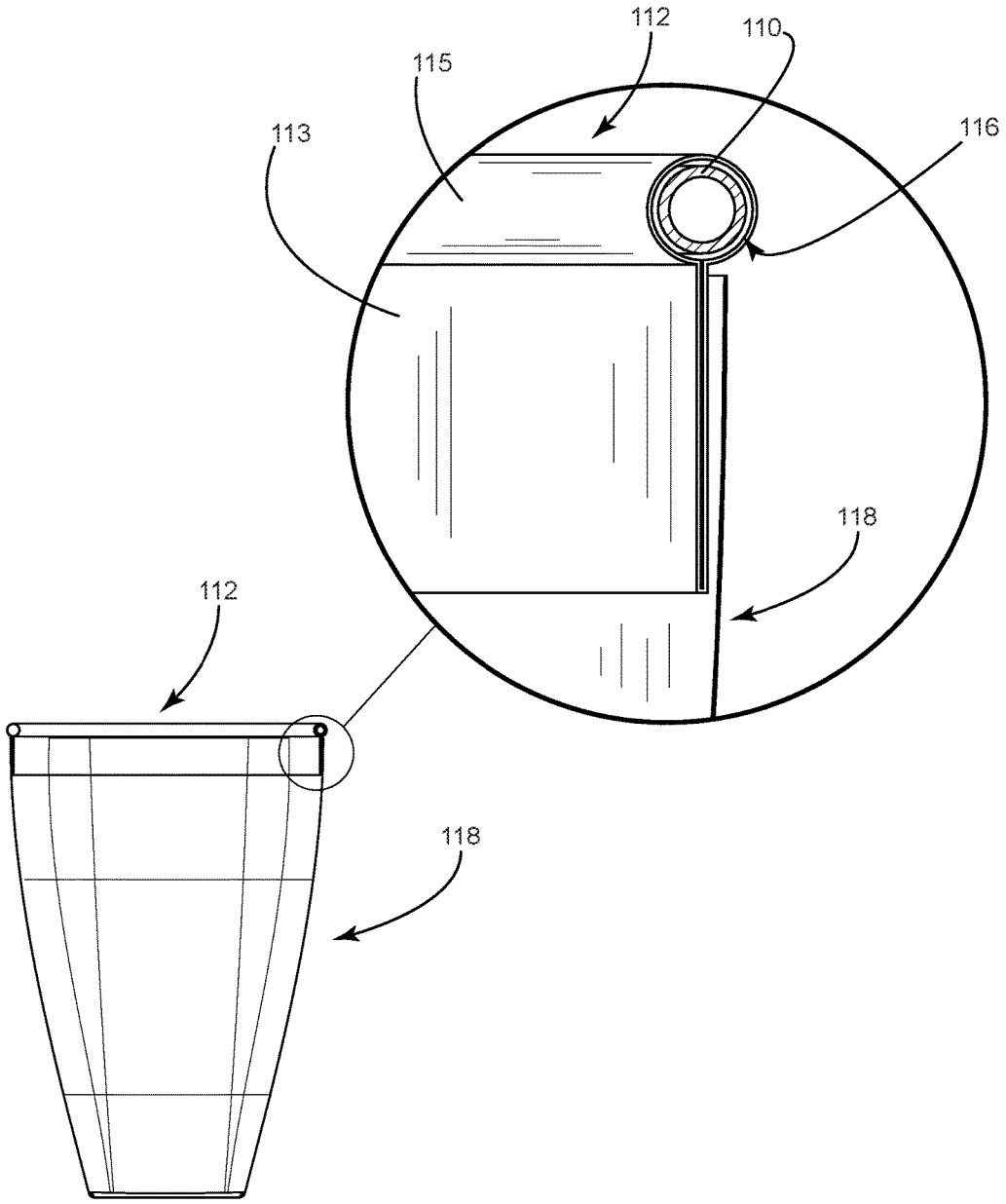
FIG. 5 is an orthographic view and a detailed, section view of the apparatus shown installed on a provided bag.

In FIG. 5, an orthographic view shows the apparatus installed on a provided bag 118. A detailed, section view shows the apparatus 112 installed, with its collar 115 resting atop the provided bag 118, and the apparatus's flange 113 against the bag's inner diameter. A section view of the collar 115 shows the partial inner ring 110 as inserted in the receiving end 116 of the collar.

The invention claimed is:

1. An apparatus for holding open a bag comprising:
an expandable annular band; and
a passive lock engaged with said annular band; and
said passive lock engaging incrementally as said annular band expands to a location fit with said bag; wherein
once expanded to fit within the opening of a bag, the passive lock holds the annular band expanded and engaged in a location fit within the opening of the bag.

2. The apparatus of claim 1 wherein the bag is a yard-waste bag.

3. An apparatus for holding open a bag comprising:
an expandable annular band; and
a passive lock engaged with said annular band; and
a semi-cylindrical vertical flange having a top edge and a bottom edge; and
a hollow collar engaged with said vertical flange about the top edge; wherein
once expanded to fit within the opening of a bag, the passive lock holds the annular band and the semi-cylindrical vertical flange expanded and engaged in a location fit within the opening of the bag while the hollow collar provides rigidity about the top edge.

4. The apparatus of claim 3 further comprising:
a flexible inner member having a first end and a second end; and
the first end of said flexible inner member fixedly engaged with said hollow collar; and
the second end of said flexible inner member fitting within, and slidably engaged with, said hollow collar; wherein
friction between the flexible inner member and the hollow collar provide a location fit that holds the annular band to a fixed diameter when expanded.

5. An apparatus for holding open a yard-waste bag comprising:
an expandable annular band having a first end and a second end; and
said expandable annular band comprising a semi-cylindrical vertical flange having a top edge and a bottom edge; and
a hollow collar engaged with said vertical flange about the top edge; and
a flexible inner member having a first end and a second; and
the first end of said flexible inner member fixedly engaged with said first end of said hollow collar; and
the second end of said flexible inner member fitting within, and slidably engaged with, said second end of said hollow collar; and
a passive lock fixedly engaged with said second end of said flexible inner member; wherein
once expanded to fit within the opening of a yard-waste bag, the passive lock holds the annular ring expanded and held in a location fit within the opening of the yard-waste bag, the vertical flange engaged against the inner surface of said yard-waste bag.

6. The apparatus of claim 5 wherein:
the flexible inner member is a hollow tube; and
the passive lock comprises a flared and splined end of said flexible inner member hollow tube; wherein
the flared and splined end provides a passive locking engagement with the hollow collar.

7. An apparatus for holding open a yard-waste bag comprising:
an expandable annular band; and
an active lock engaged with said annular band; and
said active lock engaging incrementally as said annular band expands to a location fit with said bag; wherein
once expanded to fit within the opening of a yard-waste bag and the active lock is engaged, the active lock holds the annular ring expanded and engaged in a location fit within the opening of the yard-waste bag.

8. The apparatus of claim 7; wherein
the active lock is a ratcheting mechanism.

9. The apparatus of claim 7; wherein
the active lock is a clamp.

10. The apparatus of claim 7; wherein
the active lock is a pin in a hole.

11. An apparatus for holding open a yard-waste bag comprising:
an expandable annular band having a first end and a second end; and
said expandable annular band comprising a semi-cylindrical vertical flange having a top edge and a bottom edge; and
a hollow collar engaged with said vertical flange about the top edge; and
a flexible inner member having a first end and a second end; and
the first end of said flexible inner member fixedly engaged with said first end of said hollow collar; and the second end of said flexible inner member fitting within, and slidably engaged with, said second end of said hollow collar; and an active lock fixedly engaged with said second end of said flexible inner member; wherein once expanded to fit within the opening of a yard-waste bag, the active lock engaged, holds the annular ring expanded and engaged in a location fit within the opening of the yard-waste bag, the cylindrical vertical flange engaged against the inner surface of the yard-waste bag and the hollow collar residing above the opening of the yard-waste bag.

12. The apparatus of claim 11 wherein the active lock is a ratcheting mechanism.

13. The apparatus of claim 11 wherein the active lock is a clamp.

14. The apparatus of claim 11 wherein the active lock is an interference mechanism.

* * * * *